US009744641B2

(12) United States Patent
Han

(10) Patent No.: US 9,744,641 B2
(45) Date of Patent: Aug. 29, 2017

(54) WAFER POLISHING APPARATUS

(71) Applicant: LG SILTRON INCORPORATED, Gumi-si, Gyeongsangbuk-do (KR)

(72) Inventor: Kee Yun Han, Gumi-si (KR)

(73) Assignee: LG SILTRON INCORPORATED, Gumi, Gyeongsangbuk-Do (KR)

( * ) Notice: Subject to any disclaimer, the term of this patent is extended or adjusted under 35 U.S.C. 154(b) by 55 days.

(21) Appl. No.: 14/804,513

(22) Filed: Jul. 21, 2015

(65) Prior Publication Data

US 2016/0074990 A1 Mar. 17, 2016

(30) Foreign Application Priority Data

Sep. 11, 2014 (KR) ..... 10-2014-0119969

(51) Int. Cl.

| | |
|---|---|
| ***B24B 37/00*** | (2012.01) |
| ***B24B 41/00*** | (2006.01) |
| ***B24B 37/28*** | (2012.01) |
| ***B24B 37/08*** | (2012.01) |
| ***B24B 37/02*** | (2012.01) |
| ***B24B 37/34*** | (2012.01) |
| *B24B 37/005* | (2012.01) |
| *B24B 7/17* | (2006.01) |

(52) U.S. Cl.

CPC ..... *B24B 41/005* (2013.01); *B24B 37/022* (2013.01); *B24B 37/08* (2013.01); *B24B 37/28* (2013.01); *B24B 37/345* (2013.01); *B24B 7/17* (2013.01); *B24B 37/005* (2013.01)

(58) Field of Classification Search

CPC ..... B24B 7/17; B24B 37/005; B24B 37/08; B24B 37/022; B24B 37/28; B24B 37/345; B24B 41/005

See application file for complete search history.

(56) References Cited

U.S. PATENT DOCUMENTS 3,395,494 A * 8/1968 Sogn ..... B24B 37/08 451/1
6,113,490 A * 9/2000 Hakomori ..... B24B 37/08 257/E21.23

(Continued)

FOREIGN PATENT DOCUMENTS

| | | |
|---|---|---|
| CN | 102069446 | 5/2011 |
| EP | 0 931 624 | 7/1999 |

(Continued)

OTHER PUBLICATIONS

Japanese Office Action dated Jul. 28, 2016 issued in Application No. 2015-151599.

(Continued)

*Primary Examiner* — Timothy V Eley
(74) *Attorney, Agent, or Firm* — KED & Associates LLP

(57) ABSTRACT

A wafer polishing apparatus includes a lower surface plate, an upper surface plate disposed over the lower surface plate, a carrier disposed between the lower surface plate and the upper surface plate and containing a wafer, and a lift unit lifting the carrier such that an upper surface of the carrier contacts a lower surface of the upper surface plate or lowering the carrier such that a lower surface of the carrier contacts an upper surface of the lower surface plate.

17 Claims, 9 Drawing Sheets

(56) References Cited

U.S. PATENT DOCUMENTS

| | | | | |
|---|---|---|---|---|
| 6,299,514 | B1 * | 10/2001 | Boller | B24B 37/08 257/E21.23 |
| 6,645,862 | B2 * | 11/2003 | Wenski | B24B 37/0056 257/E21.23 |
| 7,029,380 | B2 * | 4/2006 | Horiguchi | B24B 37/28 451/262 |
| 8,454,410 | B2 * | 6/2013 | Kitagawa | B24B 37/015 451/262 |
| 8,512,099 | B2 * | 8/2013 | Kerstan | B24B 7/17 451/269 |
| 8,579,679 | B2 * | 11/2013 | Fukushima | B24B 37/08 451/283 |
| 8,721,390 | B2 * | 5/2014 | Schwandner | B24B 37/044 438/692 |
| 9,299,382 | B2 * | 3/2016 | Sakai | G11B 5/8404 |
| 2004/0043713 | A1 | 3/2004 | Moriya et al. | |

FOREIGN PATENT DOCUMENTS

| | | | |
|---|---|---|---|
| JP | 63-300857 | | 12/1988 |
| JP | 09-239657 | | 9/1997 |
| JP | 2000-042912 | A | 2/2000 |
| JP | 2001-252864 | | 9/2001 |
| JP | 2005-224892 | | 8/2005 |
| JP | 2005-238404 | A | 9/2005 |
| JP | 2005-294378 | A | 10/2005 |
| JP | 2007-118146 | A | 5/2007 |
| JP | 2013-176825 | | 9/2013 |

OTHER PUBLICATIONS

Korean Notice of Allowance dated Sep. 24, 2015 issued in Application No. 10-2014-0119969.

Chinese Office Action dated May 3, 2017 issued in Application No. 201510573510.2 (English translation attached).

* cited by examiner

WAFER POLISHING APPARATUS

This application claims the benefit of Korean Patent Application No. 10-2014-0119969, filed on Sep. 11, 2014, which is hereby incorporated by reference as if fully set forth herein.

BACKGROUND OF THE INVENTION

Field of the Invention

Embodiments relate to a wafer polishing apparatus.

Discussion of the Related Art

A double side polishing (DSP) process is typically performed in such a way as to polish wafers by friction between a pad and wafers under the pressure of surface plates using slurry as an abrasive agent. The DSP process is capable of determining flatness of the wafers.

The DSP process may be implemented through mechanochemical polishing, which incorporates both a chemical process of employing chemical action between slurry and the surface of the wafer and a mechanical process of employing friction between a pad and the wafer under the pressure of surface plates.

SUMMARY OF THE INVENTION

An embodiment provides a wafer polishing apparatus capable of improving the flatness of surfaces, rear surfaces and edge portions of polished wafers.

A wafer polishing apparatus according to an embodiment includes a lower surface plate, an upper surface plate disposed over the lower surface plate, a carrier disposed between the lower surface plate and the upper surface plate and containing a wafer, and a lift unit lifting the carrier such that an upper surface of the carrier contacts a lower surface of the upper surface plate or lowering the carrier such that a lower surface of the carrier contacts an upper surface of the lower surface plate.

The wafer polishing apparatus may further includes a sun gear disposed at the center of the lower surface plate, and an internal gear disposed around the periphery of the lower surface plate, wherein the carrier may include a gear formed around an outer circumferential surface thereof and engaging with the sun gear and the internal gear, and the lift unit may lift or lower the sun gear and the internal gear.

The sun gear may include a first pin gear including a plurality of first pins, and a first support for supporting the plurality of first pins, wherein the lift unit may lift or lower the first support.

The internal gear may include a second pin gear including a plurality of second pins, and a second support for supporting the plurality of second pins, wherein the lift unit may lift or lower the second support.

The lift unit may concurrently lift or lower the first support and the second support.

The sun gear may further include first support rings projecting from outer circumferential surfaces of the plurality of respective first pins.

The first support rings may be provided at lower ends of the plurality of respective first pins and may contact an upper surface of the first support.

The first support rings may be provided at outer circumferential surface between the upper and lower ends of the plurality of respective first pins, and may be spaced apart from the upper and lower ends of the plurality of respective first pins.

The first support rings provided at the outer circumferential surfaces of two adjacent first pins of the plurality of first pins may be spaced apart from each other.

The internal gear may further include second support rings projecting from outer circumferential surfaces of the plurality of respective second pins.

The second support rings may be provided at lower ends of the plurality of respective second pins and may contact an upper surface of the second support.

The second support rings may be provided at outer circumferential surfaces of the plurality of respective second pins between the upper and lower ends of the plurality of respective second pins, and may be spaced apart from the upper and lower ends of the plurality of respective second pins.

The second support rings provided at the outer circumferential surfaces of two adjacent second pins of the plurality of second pins may be spaced apart from each other.

The lower surface plate may include a center hole, and the first support may be disposed in the center hole of the lower surface plate.

The lift unit may include a first lift part disposed under the first support to lift or lower the first support, and a second lift part disposed under the second support to lift or lower the second support.

Each of the first support rings may have a larger outer diameter than a width of the first support.

A wafer polishing apparatus according to another embodiment includes a lower surface plate, an upper surface plate disposed over the lower surface plate, a sun gear disposed at the center of the lower surface plate, an internal gear disposed around the periphery of the lower surface plate, a carrier disposed between the lower surface plate and the upper surface plate and containing a wafer, the carrier including a gear formed at an outer circumferential surface thereof and engaging with the sun gear and the internal gear, and a lift unit lifting the sun gear and the internal gear such that an upper surface of the carrier contacts a lower surface of the upper surface plate or lowering the sun gear and the internal gear such that a lower surface of the carrier contacts an upper surface of the lower surface plate.

The sun gear may include a first pin gear including a plurality of first pins, and a first support for supporting the plurality of first pins, wherein the internal gear may include a second pin gear including a plurality of second pins, and a second support for supporting the plurality of second pins, and wherein the lift unit may lift or lower the first support and the second support concurrently.

A wafer polishing apparatus according to a further embodiment includes a lower surface plate, an upper surface plate disposed over the lower surface plate, a carrier disposed between the lower surface plate and the upper surface plate and containing a wafer, a lift unit lifting the carrier such that an upper surface of the carrier contacts a lower surface of the upper surface plate or lowering the carrier such that a lower surface of the carrier contacts an upper surface of the lower surface plate, and a control unit controlling the lift unit to cause the carrier to be lifted or lowered, wherein the control unit controls the lift unit to cause a first surface of the carrier to contact one of a first surface of the upper surface plate and a first surface of the lower surface plate in a first polishing operation and to cause a second surface of the carrier to contact the other of the first surface of the upper surface plate and the first surface of the lower surface plate in a second polishing operation.

The control unit may control the lift unit to cause the first surface of the carrier to again contact the one of the first surface of the upper surface plate and the first surface of the lower surface plate in a third polishing operation.

The embodiments may improve the flatness of surfaces, rear surfaces and edge portions of polished wafers.

It is to be understood that both the foregoing general description and the following detailed description of the embodiments are exemplary and explanatory and are intended to provide further explanation of the embodiments as claimed.

BRIEF DESCRIPTION OF THE DRAWINGS

The accompanying drawings, which are included to provide a further understanding of the embodiments and are incorporated in and constitute a part of this application, illustrate embodiments, and together with the description serve to explain the principle of the embodiments. In the drawings.

DETAILED DESCRIPTION OF THE INVENTION

Figure 1:
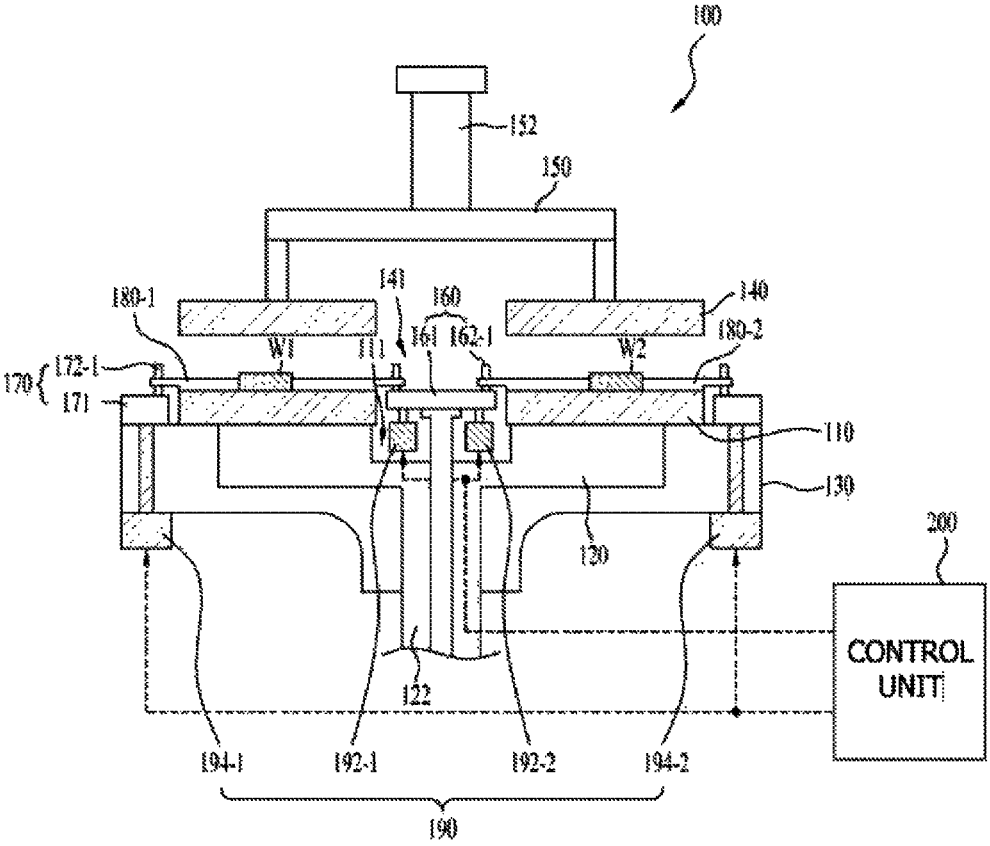
FIG. 1 is a cross-sectional view of a wafer polishing apparatus according to an embodiment.

Embodiments will become apparent from the following description of preferred embodiments with reference to the accompanying drawings. In the following description of embodiments, it will be understood that, when a layer (film), a region, a pattern or a structure is referred to as being 'on' or 'under' another element, it can be directly on/under the element, and one or more intervening elements may also be present therebetween. Here, the reference regarding 'on' or 'under' an element should be defined based on the drawings.

It should be understood that the size of the elements shown in the drawings may be exaggeratedly drawn or omitted for convenience and clarity of the explanation. Furthermore, it should be understood that the elements shown in the drawings are not drawn to scale, and the same reference numbers used throughout the different figures designate the same or similar components.

Figure 2:
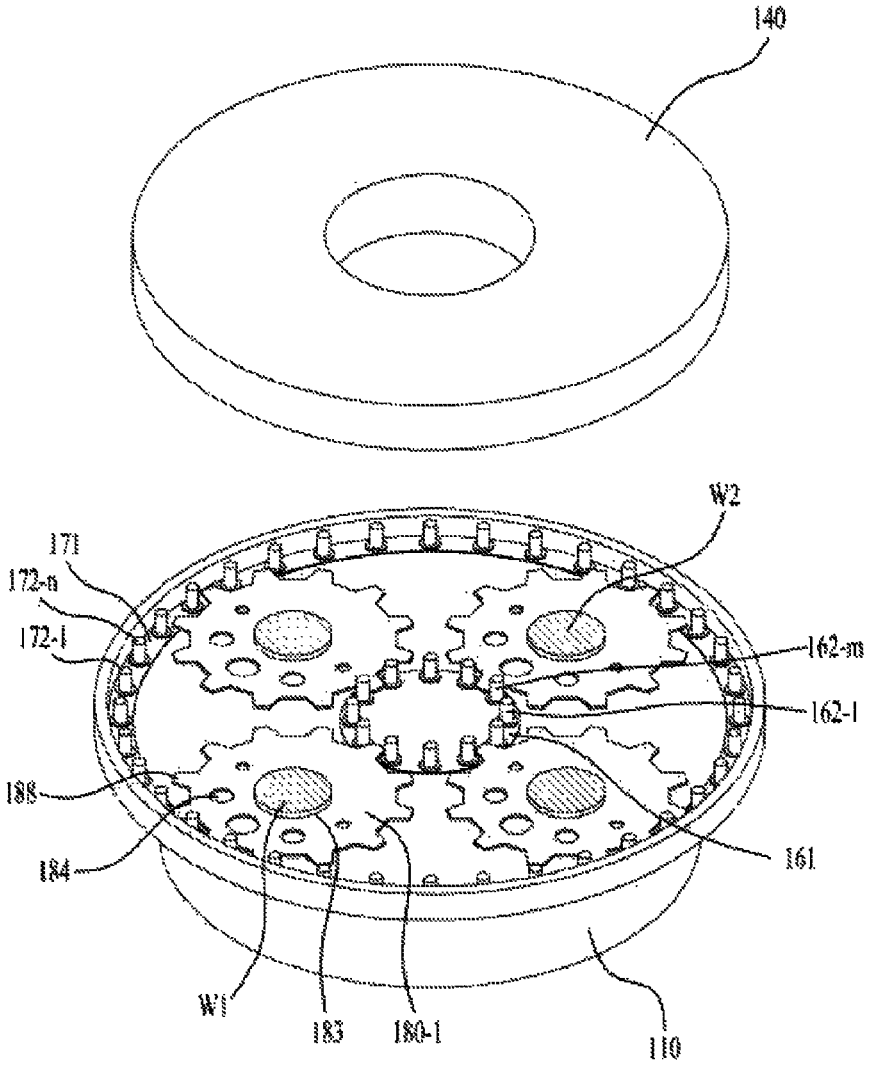
FIG. 2 is a schematic perspective view showing an upper surface plate, a lower surface plate, an internal gear and a sun gear of the wafer polishing apparatus shown in FIG. 1.

FIG. 1 is a cross-sectional view of a wafer polishing apparatus 100 according to an embodiment, and FIG. 2 is a schematic perspective view showing an upper surface plate, a lower surface plate, an internal gear and a sun gear of the wafer polishing apparatus shown in FIG. 1.

Referring to FIGS. 1 and 2, the wafer polishing apparatus 100 may include a lower surface plate 110, a lower surface plate rotator 120, a support 130, an upper surface plate 140, an upper surface plate rotator 150, a sun gear 160, an internal gear 170, one or more carriers 180-1 and 180-2, a lift unit 190, and a control unit 200.

The lower surface plate 110 may be embodied as an annular plate that supports wafers W1 and W2 loaded on the one or more carriers 180-1 and 180-2 and has a center hole 111. The lower surface plate 110 may include a polishing pad mounted on the upper surface thereof to polish the wafers.

The lower surface plate rotator 120 is disposed under the lower surface plate 110 to rotate it.

The lower surface plate rotator 120 may include a first rotating shaft 122 for rotating the lower surface plate 110. The first rotating shaft 122 may be connected to a lower surface of the lower surface plate 110 so as to support the lower surface plate 110 and to rotate the lower surface plate 110 in a first direction.

For example, the first rotating shaft 122 may be rotated in the first direction (e.g. counterclockwise) by the rotation of a driving motor (not shown), and thus the lower surface plate 110 may be rotated in the first direction (e.g. counterclockwise) by the rotational force of the first rotating shaft 122.

The upper surface plate 140 may be disposed over the lower surface plate 110 such that the lower surface of the upper surface plate 140 faces the upper surface of the lower surface plate 110. The upper surface plate 140 may be embodied as an annular plate having a center hole. The upper surface plate 140 may include a polishing pad attached to the lower surface thereof to polish wafers.

The upper surface plate rotator 150 may rotate the upper surface plate 140 to further move the upper surface plate 140 vertically.

The upper surface plate rotator 150 may include a second rotating shaft 152 connected to the upper surface plate 140 to rotate the upper surface plate 140.

The second rotating shaft 152 may be connected to the upper surface of the upper surface plate 140 to rotate the upper surface plate 140 in the second direction. The second rotating shaft 152 may vertically move the upper surface plate 140 to control the weight of the upper surface plate 140 applied to the wafers W1 and W2 loaded on the one or more carriers 180-1 and 180-2. The second direction may be the direction opposite to the first direction (e.g. the clockwise direction).

For example, the second rotating shaft 152 may be connected to a driving motor (not shown). The second rotating shaft 152 may be rotated in the second direction by the rotation of the driving motor, and the upper surface plate 140 may be rotated in the second direction by the rotational force of the second rotating shaft 152.

The second rotating shaft 152 may be connected to a pneumatic or hydraulic cylinder (not shown), and the weight of the upper surface plate 140 may be controlled by the pneumatic or hydraulic cylinder. During polishing, the upper surface plate 140 may apply pressure to the wafers W1 and W2 loaded on the one or more carriers 180-1 and 180-2. For example, the weight of the upper surface plate 140 applied to the wafers W1 and W2 loaded on the one or more carriers 180-1 and 180-2 may be controlled by the pneumatic or hydraulic cylinder (not shown).

The sun gear 160 may include a plurality of first pins 162-1 to **162-*m* (where m is a natural number satisfying m>1), and a first support 161 for supporting the plurality of first pins 162-1 to 162-*m***).

The first support 161 is disposed in the center hole 111 of the lower surface plate 110, and may be embodied as an annular plate. However, the shape of the first support 161 is not limited thereto. For example, although the first support 161 may have a ring shape, it is not limited thereto.

The plurality of first pins 162-1 to **162-*m* may be arranged in a line with intervals therebetween. The sun gear 160 shown in FIG. 2 may include a pin gear including the plurality of first pins 162-1 to 162-*m* and the first support 161**.

The internal gear 170 may be positioned around periphery of the lower surface plate 110. For example, the internal gear 170 may be embodied as an annular plate whose inner circumferential surface surrounds the outer circumferential surface of the lower surface plate 110.

The internal gear 170 may include a plurality of second pins 172-1 to **172-*n* (where n is a natural number satisfying n>1), and a second support 171 for supporting the plurality of second pins 172-1 to 172-*n***.

The second support 171 may be embodied as an annular plate disposed around the periphery of the lower surface plate 110. For example, although the second support 171 may have a ring shape, it is not limited thereto.

The plurality of second pins 172-1 to **172-*n* may be arranged in a line on the upper surface of the second support 171, with intervals therebetween. The internal gear 170 shown in FIG. 2 may include a pin gear including the plurality of second pins 172-1 to 172-*n*, and the second support 171**.

The one or more carriers 180-1 and 180-2 are disposed between the upper surface of the lower surface plate 110 and the lower surface of the upper surface plate 140, in which the wafers to be polished W1 and W2 are received or loaded.

Each of the one or more carriers 180-1 and 180-2 may include a carrier body 180 (see FIG. 4) having a wafer mount hole 183 in which the wafer W1 or W2 is received and at least one slurry hole 184 which is spaced apart from the wafer mount hole 183 and through which slurry passes, and a gear 188 provided at the outer circumferential surface of the carrier body 180.

The slurry holes 184 may have the same diameter or different diameters, and may have a smaller diameter than that of the wafer mount hole 183.

The one or more carriers 180-1 and 180-2 may be made of epoxy glass, SUS, urethane, ceramics, or polymer.

Although the carrier body 180 may have a disc shape, it is not limited thereto.

The gear 188 formed at the outer circumferential surface of the carrier 180-1 or 180-2 may engage with both the first pins 162-1 to **162-*m* of the sun gear 160 and the second pins 172-1 to 172-*n* of the internal gear 170. The one or more carriers 180-1 and 180-2 may engage with both the sun gear 160 and the internal gear 170** so as to be rotated thereby during the polishing process.

The lift unit 190 may be configured to lift or lower the one or more carriers 180-1 and 180-2 disposed on the upper surface of the lower surface plate 110.

The lift unit 190 may lift or lower the sun gear 160 and the internal gear 170. For example, the lift unit 190 may lift or lower the sun gear 160 and the internal gear 170 concurrently.

The lift unit 190 may also lift or lower the sun gear 160 and the internal gear 170 while polishing wafers received in the carriers 180-1 and 180-2, which are rotated between the sun gear 160 and the internal gear 170 due to the rotation of the upper surface plate 140 and the lower surface plate 110.

The lift unit 190 may include first lift parts 192-1 and 192-2 for lifting or lowering the sun gear 160, and second lift parts 194-1 and 194-2 for lifting or lowering the internal gear 170.

For example, the first lift parts 192-1 and 192-2 may be disposed under the first support 161 to lift or lower the first support 161.

The first lift parts 192-1 and 192-2 may include one or more first lift parts. For example, the first lift parts 192-1 and 192-2 may include a plurality of first lift parts, and the plurality of first lift parts may concurrently lift or lower different portions of the first support 161.

The second lift parts 194-1 and 194-2 may be disposed under the second support 171 to lift or lower the second support 171.

The second lift parts 194-1 and 194-2 may include one or more second lift parts. For example, the second lift parts 194-1 and 194-2 may include a plurality of second lift parts, and the plurality of second lift parts may concurrently lift or lower the different portions of the second support 171.

The first lift parts 192-1 and 192-2 and the second lift parts 194-1 and 194-2 may each include a pneumatic or hydraulic cylinder, and may lift or lower the first support 161 and the second support 171 by using pressure supplied from the pneumatic or hydraulic cylinder.

In another embodiment, each of the first lift parts 192-1 and 192-2 and the second lift parts 194-1 and 194-2 may include an up-down motor that is configured to convert the rotational force generated by driving the motor into a vertical linear movement, and thus lifting or lowering the first support 161 and the second support 171 by the vertical linear movement.

As the first support 161 is lifted or lowered, the first pins 162-1 to **162-*m* secured to the first support 161 and the second pins 172-1 to 172-*n* secured to the second support 171** may also be lifted or lowered therewith.

Furthermore, as the first support 161 and the second support 171 are lifted or lowered, the one or more carriers 180-1 and 180-2 engaging with the first pins 162-1 to **162-*m* and the second pins 172-1 to 172-*m*** may also be lifted or lowered therewith.

By virtue of the first lift parts 192-1 and 192-2 and the second lift part 194-1 and 194-2, the first support 161 and the second support 171 may be lifted or lowered therewith, thus lifting or lowering the one or more carriers 180-1 and 180-2.

Even though the one or more carriers 180-1 and 180-2 are lifted or lowered, the wafers W1 and W2 received in the wafer mount holes 183 are not lifted or lowered but are kept on the lower surface plate 110.

Figure 3A:
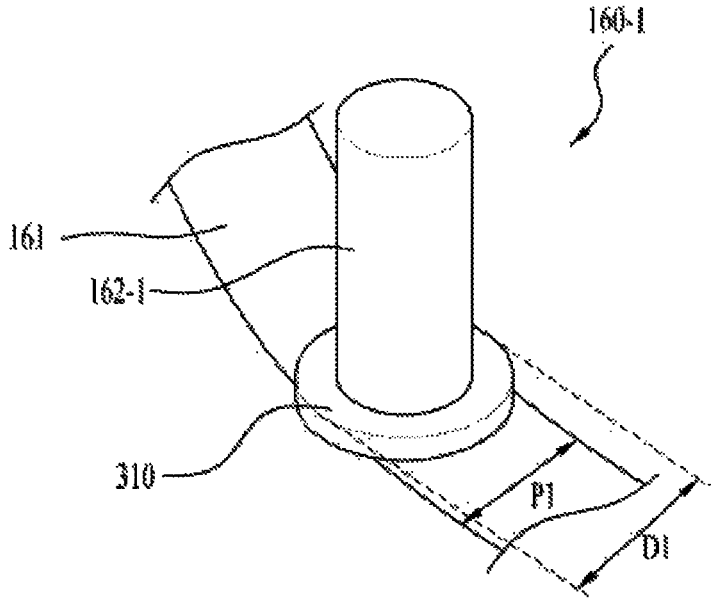
FIG. 3A is an enlarged perspective view of an embodiment of the sun gear shown in FIG. 1.

FIG. 3A is an enlarged perspective view of an embodiment 160-1 of the sun gear shown in FIG. 1.

Referring to FIG. 3A, the sun gear 160-1 may further include a first support ring 310 projecting outward from the outer circumferential surface of each of the first pins 162-1 to **162-*m***.

The first support ring 310 may be provided at the lower end of each of the first pins 162-1 to **162-*m* so as to contact the upper surface of the first support 161**.

The first support ring 310 serves as a shoulder support for supporting the gear 188 formed on the outer circumferential surface of each of the carriers 180-1 and 180-2.

The first support rings 310 provided at adjacent first pins may be spaced apart from each other. In order to reliably support the gear 188 formed on the outer circumferential surface of each of the carriers 180-1 and 180-2, the diameter D1 of the outer circumferential surface of the first support ring 310 may be greater than the width P1 of the first support 161. However, this embodiment is not limited thereto.

Figure 4:
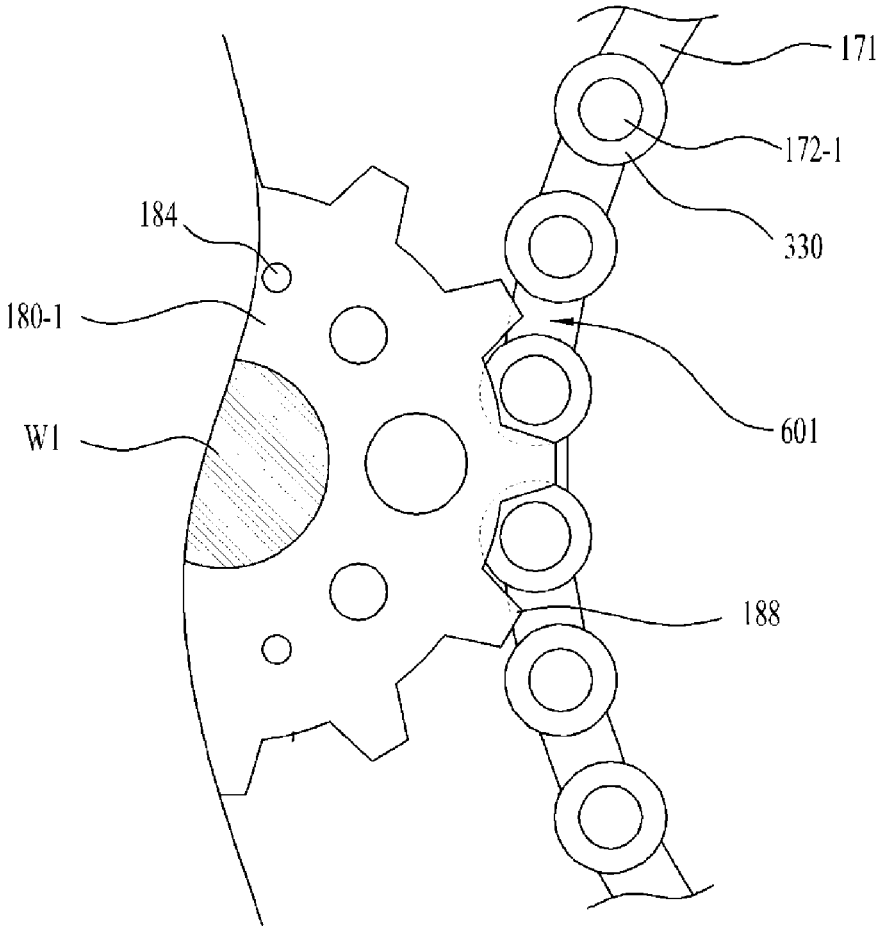
FIG. 4 is a plan view of a gear of a carrier mounted on the first support ring shown in FIG. 3A.

FIG. 4 is a plan view of the gear 188 of the carrier 180-1 placed on the first support ring 310 shown in FIG. 3A.

Referring to FIG. 4, the first support ring 310 increases the area of contact with the gear 188 formed on the outer circumferential surface of each of the carriers 180-1 and 180-2. Consequently, the first support ring 310 may reliably support the carriers 180-1 and 180-2 when the carriers 180-1 and 180-2 are lifted or lowered by means of the lift unit 190.

Figure 3B:
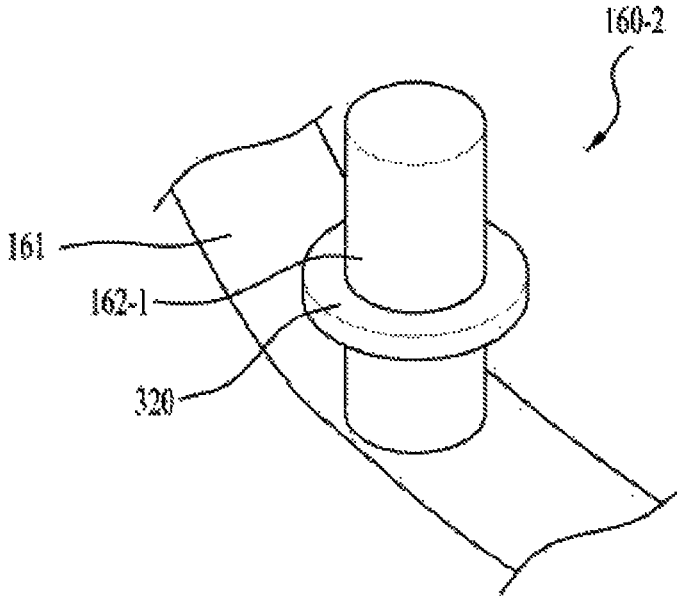
FIG. 3B is an enlarged perspective view of another embodiment of the sun gear shown in FIG. 1.

FIG. 3B is an enlarged perspective view of another embodiment 160-2 of the sun gear shown in FIG. 1.

Referring to FIG. 3B, the sun gear 160-2 may further include a first support ring 320 projecting outward from an outer circumferential surface portion positioned between the upper and lower ends of each of the first pins 162-1 to **162-*m***.

The first support ring 320 may be disposed to be spaced apart from the upper and lower ends of the first pin (for example, 162-1). Although the diameter of the first support ring 320 may be greater than the width of the first support 161, it is not limited thereto.

Figure 5A:
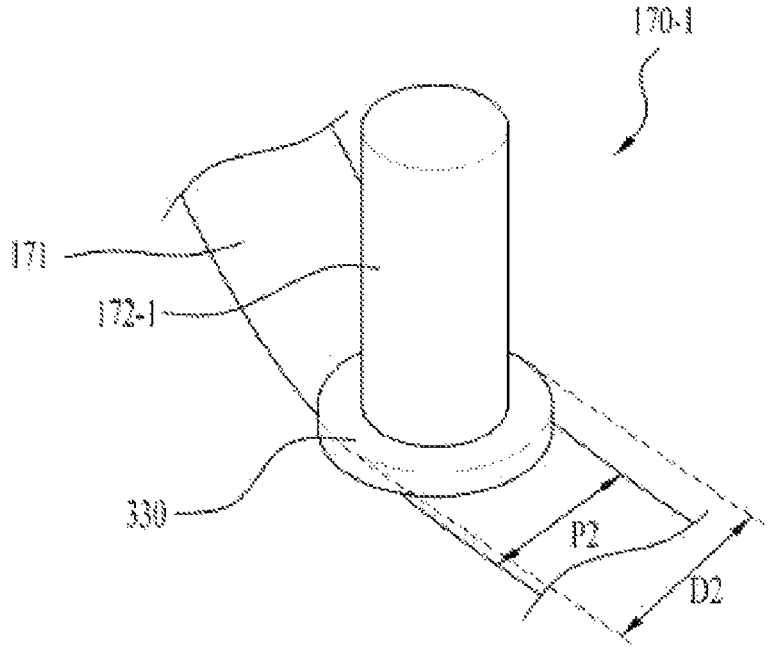
FIG. 5A is an enlarged perspective view of an embodiment of the internal gear shown in FIG. 1.

FIG. 5A is an enlarged perspective view of an embodiment 170-1 of the internal gear shown in FIG. 1.

Referring to FIG. 5A, the internal gear 170-1 may further include a second support ring 330 projecting outward from the outer circumferential surface of each of the second pins 172-1 to **172-*n***.

The second support ring 330 may be provided at the lower end of each of the second pins 172-1 to **172-*n*, and may contact the upper surface of the second support 171**.

The second support ring 330 serves as a shoulder support for supporting the gear 188 formed on the outer circumferential surface of each of the carriers 180-1 and 180-2.

The second support rings 330, provided at two of the second pins that are adjacent to each other, may be spaced apart from each other. In order to reliably support the gear 188 formed on the outer circumferential surface of each of the carriers 180-1 and 180-2, the diameter D1 of the outer circumferential surface of the second support ring 330 may be greater than the width P1 of the second support 171. However, the embodiment is not limited thereto.

Figure 6:
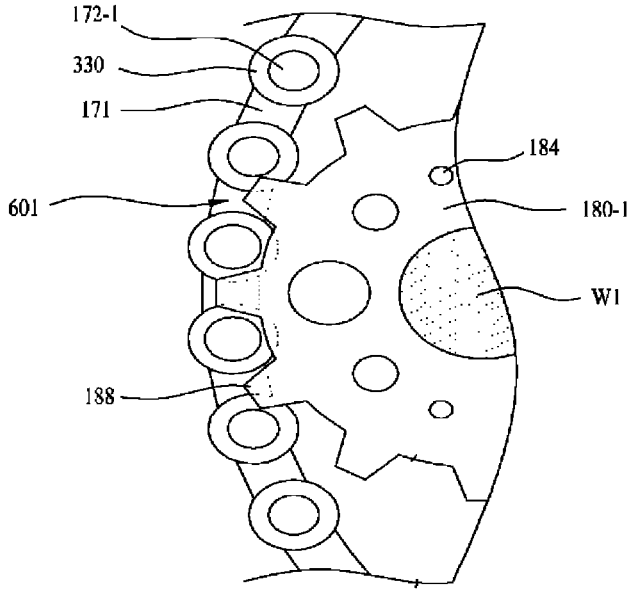
FIG. 6 is a plan view of a gear of a carrier mounted on the second support ring shown in FIG. 5A.

FIG. 6 is a plan view of the gear 188 of the carrier 180-1 placed on the second support ring 330 shown in FIG. 5A.

Referring to FIG. 6, the second support ring 330 increases the area of contact with the gear 188 formed on the outer circumferential surface of each of the carriers 180-1 and 180-2. Consequently, the second support ring 330 may reliably support the carriers 180-1 and 180-2 when the carriers 180-1 and 180-2 are lifted or lowered by means of the lift unit 190.

Figure 5B:
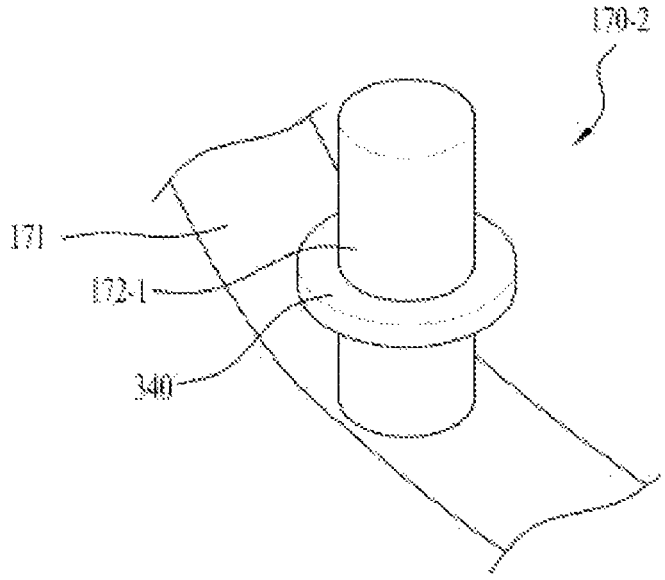
FIG. 5B is an enlarged perspective view of another embodiment of the internal gear shown in FIG. 1.

FIG. 5B is an enlarged perspective view of another embodiment 170-2 of the internal gear shown in FIG. 1.

Referring to FIG. 5B, the internal gear 170-2 may further include a second support ring 340 projecting outward from the outer circumferential surface portion positioned between the upper and lower ends of each of the second pins 172-1 to **172-*n***.

The second support ring 340 may be disposed to be spaced apart from the upper and lower ends of the second pin (for example, 172-1). Although the diameter of the second support ring 340 may be greater than the width of the second support 171, it is not limited thereto.

The control unit 200 controls the lift unit 190 to cause the one or more carriers 180-1 and 180-2 to be lifted or lowered.

For example, the control unit 200 may control the first lift parts 192-1 and 192-2 to cause the first support 161 to be lifted or lowered, and may control the second support 171 to cause the second lift parts 194-1 and 194-2 to be lifted or lowered.

Figure 10:
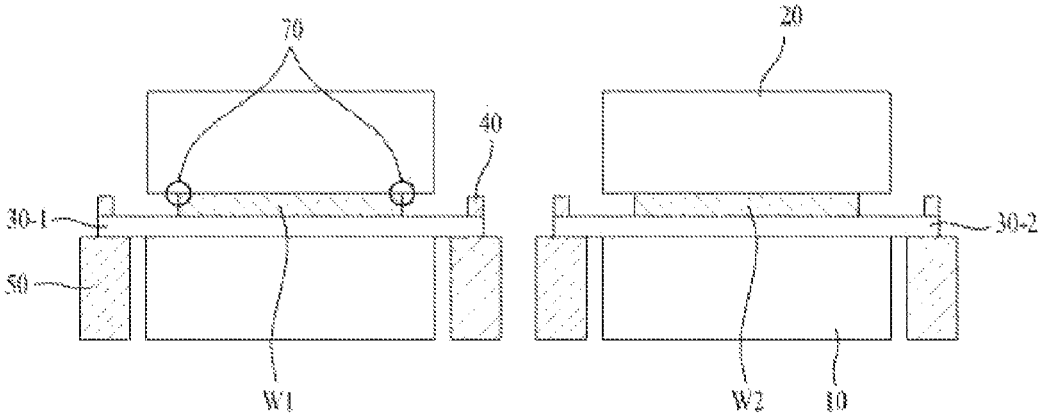
FIG. 10 is a cross-sectional view of a conventional wafer polishing apparatus.

FIG. 10 is a cross-sectional view of a typical wafer polishing apparatus.

Referring to FIG. 10, the conventional process of polishing wafers W1 and W2 employs a construction such that carriers 30-1 and 30-2, which contain the wafers W1 and W2 received therein, are positioned between a sun gear 40 and an internal gear 50 to engage therewith and are mounted on the upper surface of a lower surface plate 10, thus polishing the wafers W1 and W2 using the upper surface plate 20 and the lower surface plate 10.

Owing to the difference between the thickness of the carriers 30-1 and 30-2 and the initial thickness of the wafers not subjected to polishing, the working load 70 applied to the edge of the upper surface of the wafer that contacts the upper surface plate 20 is increased to be higher than the working load applied to other portions of the upper surface of the wafer, and thus the flatness of the upper surface of the wafer may be deteriorated.

Figure 7A:
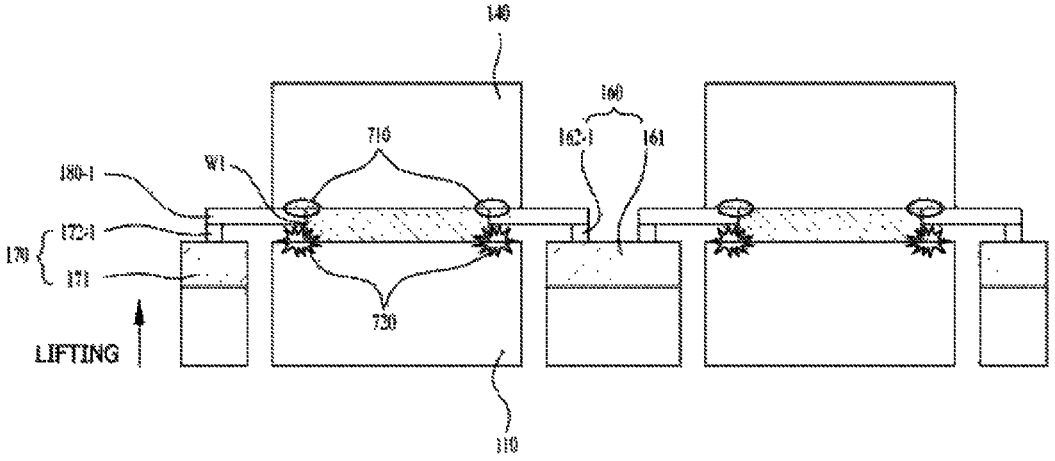
FIGS. 7A and 7B are cross-sectional views showing a process of polishing wafers according to an embodiment.
Figure 7B:
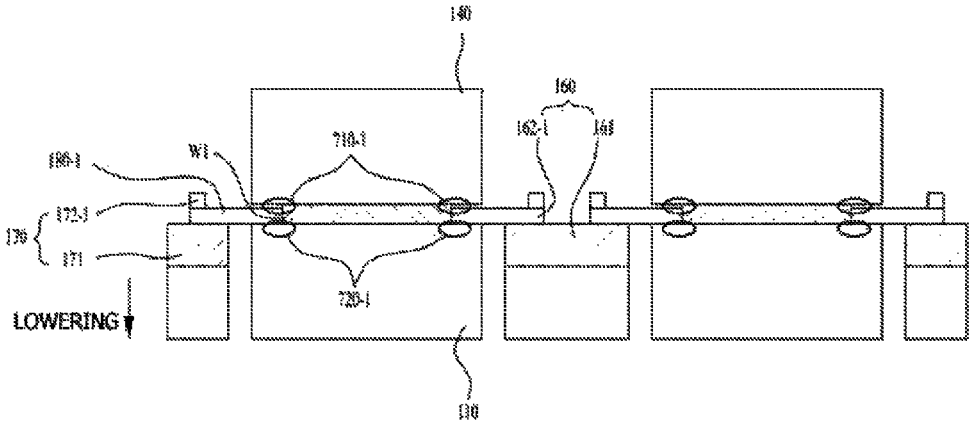

FIGS. 7A and 7B illustrate the process of polishing wafers according to an embodiment.

The process of polishing wafers according to the embodiment may include a first polishing operation, shown in FIG. 7A, and a second polishing operation, shown in FIG. 7B.

Referring to FIG. 7A, the one or more carriers 180-1 and 180-2 containing the wafers W1 and W2 are mounted on the upper surface of the lower surface plate 110.

At this point, the initial thickness (t1) of the wafers not subjected to polishing may be different from the thickness (t2) of the carriers 180-1 and 180-2. For example, the initial thickness (t1) of the wafers W1 and W2 not subjected to polishing may be greater than the thickness (t2) of at least one of the carriers 180-1 and 180-2 (t1>t2).

Owing to the difference between the initial thickness t1 of the wafers not subjected to polishing and the thickness (t2) of the carriers 180-1 and 180-2, the upper surfaces of the wafers disposed on the upper surface of the lower surface plate 110 may be positioned to be higher than the upper surfaces of the carriers 180-1 and 180-2.

In other words, when the lower surface of the upper surface plate 140 is caused to contact the upper surfaces of the wafers W1 and W2 received in the carriers 180-1 and 180-2, the upper surfaces of the wafers may contact the lower surface of the upper surface plate 140, but the upper surfaces of the carriers 180-1 and 180-2 may be spaced apart from the lower surface of the upper surface plate 140.

Subsequently, the lower surface of the upper surface plate 140 is caused to contact the upper surfaces of the wafers W1 and W2 received in the carriers 180-1 and 180-2.

The one or more carriers 180-1 and 180-2 are lifted by means of the lift unit 190 such that the upper surfaces of the one or more carriers 180-1 and 180-2 mounted on the lower surface plate 110 come into contact with the lower surface of the upper surface plate 140 and the lower surfaces of the carriers 180-1 and 180-2 are spaced apart from the upper surface of the lower surface plate 110.

For example, lifting the first support 161 and the second support 171 by the first and second lift parts 192-1, 192-2, 194-1 and 194-2 causes the upper surfaces of the one or more carriers 180-1 and 180-2 mounted on the lower surface plate 110 to come into contact with the lower surface of the upper surface plate 140 while causing the lower surfaces of the carriers 180-1 and 180-2 to be spaced apart from the upper surface of the lower surface plate 110.

The wafers W1 and W2 received in the one or more carriers 180-1 and 180-2 are polished while the upper surfaces of the one or more carriers 180-1 and 180-2 are in contact with the lower surface of the upper surface plate 140.

The first polishing operation may be performed until the polished wafers have a first thickness. For example, the first thickness may be in a range of 10% to 60% of the difference between the initial thickness (t1) of the wafers not subjected to polishing and the desired final target thickness of the wafers W1 and W2.

As shown in FIG. 7A, since the upper surfaces of the carriers 180-1 and 180-2 contact the lower surface of the upper surface plate 140 in the first polishing operation, the working load 710 applied to the edges of the upper surfaces of the wafers W1 and W2 is lower than the working load 720 applied to the edges of the lower surfaces of the wafers W1 and W2.

The term "working load" used herein may refer to the force applied to the wafers W1 and W2 by the upper surface plate 140. In some cases, when a first polishing pad is mounted on the upper surface plate 140 and a second polishing pad is mounted on the lower surface plate 110, the working load may refer to the frictional load between the wafers W1 and W2 and the first and second polishing pads.

Since the working load 710 applied to the edges of the upper surfaces of the wafers W1 and W2 is lower than the working load 70 applied to the edges of the upper surfaces of the wafers shown in FIG. 10, the flatness of the upper surfaces of the wafers W1 and W2 that have been polished in the first polishing operation may be improved.

As shown in FIG. 7B, after the first polishing operation, the one or more carriers 180-1 and 180-2 are lowered by means of the lift unit 190 such that the lower surfaces of the one or more carriers 180-1 and 180-2 come into contact with the upper surface of the lower surface plate 110.

For example, lowering the first support 161 and the second support 171 by the first and second lift units 192-1, 192-2, 194-1 and 194-2 causes the lower surfaces of the one or more carriers 180-1 and 180-2 to come into contact with the upper surface of the lower surface plate 110.

The wafers W1 and W2 that were polished in the first polishing operation are secondly polished to the desired final target thickness of the wafers W1 and W2 while the lower surfaces of the one or more carriers 180-1 and 180-2 are in contact with the upper surface of the lower surface plate 110.

For example, the wafers W1 and W2 that were polished in the first polishing operation may be secondly polished by the difference between the first thickness and the final target thickness.

Since the lower surfaces of the carriers 180-1 and 180-2 are in contact with the upper surface of the lower surface plate 110 in the second polishing operation, the working load 720-1 applied to the edges of the lower surfaces of the wafers W1 and W2 is lower than the working load 720 applied to the edges of the lower surfaces of the wafers W1 and W2 in the first polishing operation.

Since the working load 720-1 applied to the edges of the lower surfaces of the wafers W1 and W2 in the second polishing operation is decreased to be lower than that in the first polishing operation, the flatness of the lower surfaces of the wafers W1 and W2 may be improved.

The embodiment may improve the flatness of the upper surfaces of the wafers W1 and W2 by lifting the carriers 180-1 and 180-2 to cause the upper surfaces of the carriers 180-1 and 180-2 to contact the lower surface of the upper surface plate 140 in the first polishing operation. Furthermore, the embodiment may improve the flatness of the lower surfaces of the wafers W1 and W2 by lowering the carriers 180-1 and 180-2 to cause the lower surfaces of the carriers 180-1 and 180-2 to contact the upper surface of the lower surface plate 110 in the second polishing operation.

Figure 8A:
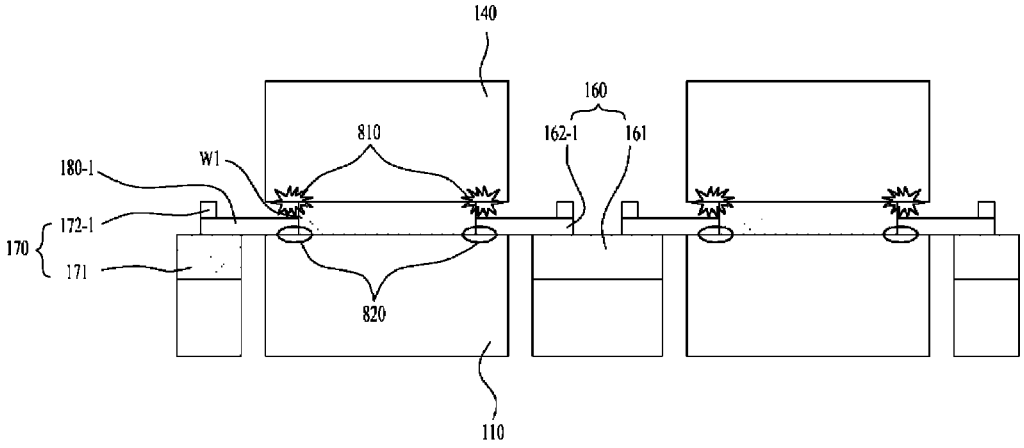
FIGS. 8A to 8C are cross-sectional views showing a process of polishing wafers according to another embodiment.
Figure 8B:
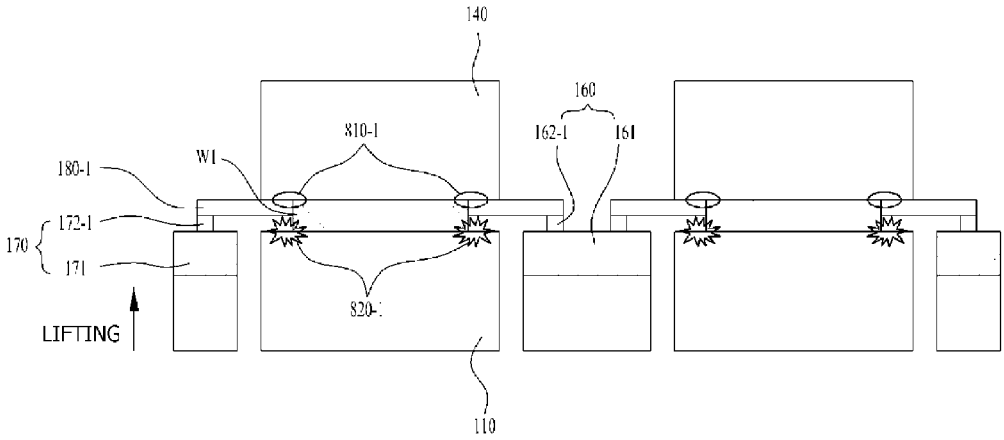
Figure 8C:
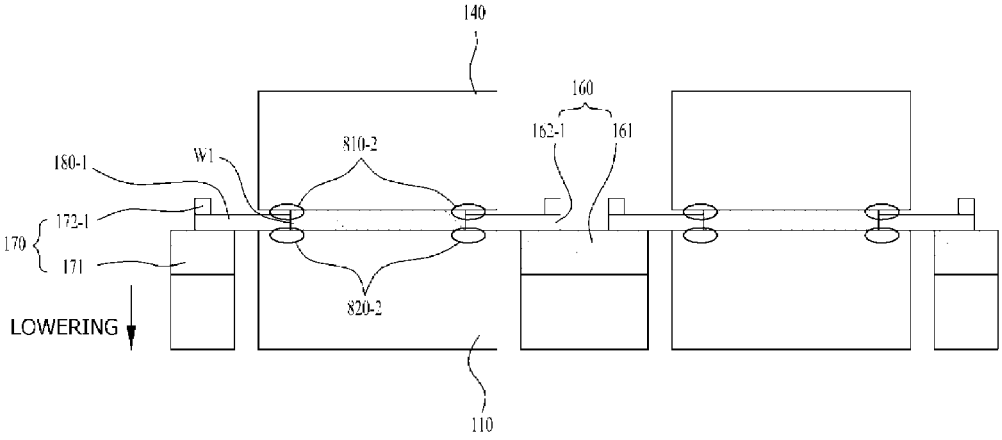

FIGS. 8A to 8C illustrate the process of polishing wafers according to another embodiment.

The process of polishing wafers according to this embodiment may include a first polishing operation, shown in FIG. 8A, a second polishing operation, shown in FIG. 8B, and a third polishing operation, shown in FIG. 8C.

For examples, in the first polishing operation, the lift unit 190 may be controlled to cause the carriers 180-1 and 180-2 to be moved such that first surfaces of the carriers 180-1 and 180-2 come into contact with one of a first surface of the upper surface plate 140 and a first surface of the lower surface plate 110.

In the second polishing operation, the lift unit 190 may be controlled to cause the carriers 180-1 and 180-2 to be moved such that second surfaces of the carriers 180-1 and 180-2 come into contact with the other of the first surface of the upper surface plate 140 and the first surface of the lower surface plate 110.

In the third polishing operation, the lift unit 190 is controlled to cause the carriers 180-1 and 180-2 to be moved such that the first surfaces of the carriers 180-1 and 180-2 again come into contact with the one of the first surface of the upper surface plate 140 and the first surface of the lower surface plate 110.

The first surfaces of the carriers 180-1 and 180-2 may be opposite to the second surfaces of the carriers 180-1 and 180-2. When the first surface of the upper surface plate 140 is the upper surface thereof, the first surface of the lower surface plate 110 may be the lower surface thereof, and vice versa. The moving direction of the carriers 180-1 and 180-2 in the first polishing operation may be opposite to the moving direction of the carriers 180-1 and 180-2 in the second polishing operation. Furthermore, the moving direction of the carriers 180-1 and 180-2 in the third polishing operation may be opposite to the moving direction of the carriers 180-1 and 180-2 in the second polishing operation.

Referring to FIG. 8A, positions of the carriers 180-1 and 180-2 are controlled by the lift unit 190 such that the lower surfaces of the carriers come into contact with the upper surface of the lower surface plate 110.

For example, the first support 161 and the second support 171 may be lowered by the first and second parts 192-1, 192-2, 194-1 and 194-2 such that the lower surfaces of the carriers 180-1 and 180-2 come into contact with the upper surface of the lower surface plate 110.

The wafers W1 and W2 received in the one or more carriers 180-1 and 180-2 are first polished while the lower surfaces of the one or more carriers 180-1 and 180-2 are in contact with the upper surface of the lower surface plate 110.

The first polishing operation may be performed until the polished wafers have a second thickness. For example, the second thickness may be in a range of 10% to 80% of the difference between the initial thickness (t1) of the wafers not subjected to polishing and the desired final target thickness of the wafers W1 and W2.

Since the working load 820 applied to the edges of the lower surfaces of the wafers W1 and W2 is lower than the working load 810 applied to the edges of the upper surfaces of the wafers W1 and W2 in the first polishing operation, the flatness of the lower surfaces of the wafers may be improved compared to the upper surfaces of the wafers.

Referring to the FIG. 8B, after the first polishing operation, the one or more carriers 180-1 and 180-2 are lifted by the lift unit 190 such that the upper surfaces of the one or more carriers 180-1 and 180-2 come into contact with the lower surface of the upper surface plate 140 whereas the lower surfaces of the carriers 180-1 and 180-2 are spaced apart from the upper surface of the lower surface plate 110.

The wafers W1 and W2 are secondly polished while the upper surfaces of the one or more carriers 180-1 and 180-2 are in contact with the lower surface of the upper surface plate 140. The second polishing operation may be performed until the wafers W1 and W2 have a third thickness. For example, the third thickness may be in a range of 10% to 70% of the difference between the third thickness and the second thickness.

Since the working load applied to the edges of the upper surfaces of the wafers W1 and W2 in the second polishing operation is lower than that in the first polishing operation, the flatness of the upper surfaces of the wafers may be improved compared to that in the first polishing operation.

The working load 820-1 applied to the edges of the lower surfaces of the wafers W1 and W2 is higher than that in the first polishing operation but may be lower than the working load applied to the edges of the lower surfaces of the wafers shown in FIG. 7A because the difference between the thickness of the wafers and the thickness of the carriers is decreased. Accordingly, the flatness of the lower surfaces of the wafers in the second polishing operation may be improved compared to the flatness of the lower surfaces of the wafers shown in FIG. 7A.

Referring to FIG. 8C, after the second polishing operation, the carriers 180-1 and 180-2 are lowered by the lift unit 190 such that the lower surfaces of the carriers 180-1 and 180-2 come into contact with the upper surface of the lower surface plate 110.

The wafers W1 and W2 that were secondly polished are thirdly polished while the lower surfaces of the carriers 180-1 and 180-2 are in contact with the upper surface of the lower surface plate 110 until the wafers W1 and W2 have the final target thickness.

In the third polishing operation, since the lower surfaces of the carriers 180-1 and 180-2 are in contact with the upper surface of the lower surface plate 110, the working load 820-1 applied to the edges of the wafers that were secondly polished may be decreased, and thus the flatness of the lower surfaces of the wafers W1 and W2 may be improved.

In addition, since the difference between the thickness of the wafers W1 and W2 and the thickness of the carriers 180-1 and 180-2 is further decreased, the difference between the working load of the edges of the upper surfaces of the wafers and the working load of other portions of the upper surfaces of the wafers may be decreased, and thus the flatness of the upper surfaces of the wafers may also be improved.

Figure 9A:
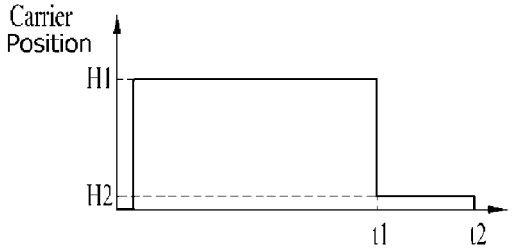
FIG. 9A is a view illustrating positions of the carriers shown in FIG. 7A and FIG. 7B.

FIG. 9A illustrates the positions of the carriers shown in FIGS. 7A and 7B.

In the drawing, the x axis denotes the polishing time, and the y axis denotes the height of the carriers.

Referring to FIG. 9A, in the first polishing operation (section of 0-t1), the one or more carriers 180-1 and 180-2 may be lifted, and the height of the upper surfaces of the carriers 180-1 and 180-2 from the upper surface of the lower surface plate 110 may be a first height (H1). For example, the first height (H1) may be the distance from the upper surface of the lower surface plate 110 to the upper surfaces of the carriers 180-1 and 180-2 when the upper surfaces of the carriers 180-1 and 180-2 contact the lower surface of the upper surface plate 140.

In the second polishing operation (section of t1-t2), the one or more carriers 180-1 and 180-2 may be lowered, and the height of the upper surfaces of the carriers 180-1 and 180-2 from the upper surface of the lower surface plate 110 may be a second height (H2). For example, the second height (H2) may be the distance from the upper surface of the lower surface plate 110 to the upper surfaces of the carriers 180-1 and 180-2 when the lower surfaces of the carriers 180-1 and 180-2 contact the upper surface of the lower surface plate 110.

Figure 9B:
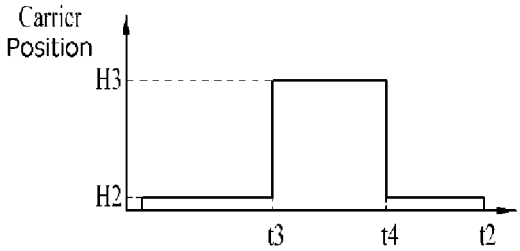
FIG. 9B is a view illustrating positions of the carriers shown in FIGS. 8A to 8C.

FIG. 9B illustrates the positions of the carriers shown in FIGS. 8A and 8B.

Referring to FIG. 9B, in the first polishing operation (section of 0-t3), the height of the upper surfaces of the carriers 180-1 and 180-2 from the upper surface of the lower surface plate 110 may be a second height (H2).

In the second polishing operation (section of t3-t4), the one or more carriers 180-1 and 180-2 may be lifted, and the height of the upper surfaces of the carriers 180-1 and 180-2 from the upper surface of the lower surface plate 110 may be a third height (H3). For example, the third height (H3) may be the distance from the upper surface of the lower surface plate 110 to the upper surfaces of the carriers 180-1 and 180-2 when the upper surfaces of the carriers 180-1 and 180-2, which contain the secondly polished wafers, contact the lower surface of the upper surface plate 140.

In the third polishing operation (section of t4-t2), the one or more carriers 180-1 and 180-2 may be lowered, and the height of the upper surfaces of the carriers 180-1 and 180-2 from the upper surface of the lower surface plate 110 may be a second height (H2).

The embodiments may improve the flatness of surfaces, rear surfaces and edge portions of polished wafers by reducing the difference between the upper surfaces of the carriers 180-1 and 180-2 and the upper surfaces of the wafers W1 and W2 and the difference between the lower surfaces of the carriers 180-1 and 180-2 and the lower surfaces of the wafers W1 and W2 by lifting and lowering the carriers 180-1 and 180-2.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A wafer polishing apparatus comprising:

a lower surface plate;

an upper surface plate disposed over the lower surface plate;

a sun gear disposed at a center of the lower surface plate;

an internal gear disposed around the periphery of the lower surface plate;

a carrier disposed between the lower surface plate and the upper surface plate for containing a wafer, the carrier including a gear formed around an outer circumferential surface thereof and engaging with the sun gear and the internal gear; and a lift unit configured to lift the sun gear and the internal gear such that an upper surface of the carrier contacts a lower surface of the upper surface plate or configured to lower the sun gear and the internal gear such that a lower surface of the carrier contacts an upper surface of the lower surface plate.

2. The wafer polishing apparatus according to claim 1, wherein the sun gear comprises:

a first pin gear including a plurality of first pins; and a first support for supporting the plurality of first pins, wherein the lift unit lifts or lowers the first support.

3. The wafer polishing apparatus according to claim 2, wherein the internal gear comprises:

a second pin gear including a plurality of second pins; and a second support for supporting the plurality of second pins, wherein the lift unit lifts or lowers the second support.

4. The wafer polishing apparatus according to claim 3, wherein the lift unit concurrently lifts or lowers the first support and the second support.

5. The wafer polishing apparatus according to claim 3, wherein the internal gear further comprises second support rings projecting from outer circumferential surfaces of the plurality of second pins.

6. The wafer polishing apparatus according to claim 5, wherein the second support rings are provided at lower ends of the plurality of respective second pins and contact an upper surface of the second support.

7. The wafer polishing apparatus according to claim 5, wherein the second support rings are provided at outer circumferential surfaces of the plurality of respective second pins between the upper and lower ends of the plurality of respective second pins and are spaced apart from the upper and lower ends of the plurality of respective second pins.

8. The wafer polishing apparatus according to claim 5, wherein the second support rings provided at the outer circumferential surfaces of two adjacent second pins of the plurality of second pins are spaced apart from each other.

9. The wafer polishing apparatus according to claim 3, wherein the lift unit comprises:

a first lift part disposed under the first support to lift or lower the first support; and a second lift part disposed under the second support to lift or lower the second support.

10. The wafer polishing apparatus according to claim 2, wherein the sun gear further comprises first support rings projecting from outer circumferential surfaces of the plurality of first pins.

11. The wafer polishing apparatus according to claim 10, wherein the first support rings are provided at lower ends of the plurality of respective first pins and contact an upper surface of the first support.

12. The wafer polishing apparatus according to claim 10, wherein the first support rings are provided at outer circumferential surfaces between the upper and lower ends of the plurality of respective first pins and are spaced apart from the upper and lower ends of the plurality of respective first pins.

13. The wafer polishing apparatus according to claim 10, wherein the first support rings provided at the outer circumferential surfaces of two adjacent first pins of the plurality of first pins are spaced apart from each other.

14. The wafer polishing apparatus according to claim 10, wherein each of the first support rings has a larger outer diameter than a width of the first support.

15. The wafer polishing apparatus according to claim 2, wherein the lower surface plate includes a center hole, and the first support is disposed in the center hole of the lower surface plate.

16. A wafer polishing apparatus comprising:

a lower surface plate;

an upper surface plate disposed over the lower surface plate;

a sun gear disposed at a center of the lower surface plate;

an internal gear disposed around the periphery of the lower surface plate;

a carrier disposed between the lower surface plate and the upper surface plate and containing a wafer, the carrier including a gear formed around an outer circumferential surface thereof and engaging with the sun gear and the internal gear;

a lift unit configured to lift the sun gear and the internal gear such that an upper surface of the carrier contacts a lower surface of the upper surface plate or configured to lower the sun gear and the internal gear such that a lower surface of the carrier contacts an upper surface of the lower surface plate; and a control unit to control the lift unit to cause the carrier to be lifted or lowered, wherein the control unit controls the lift unit to cause a first surface of the carrier to contact one of a first surface of the upper surface plate and a first surface of the lower surface plate in a first polishing operation and to cause a second surface of the carrier to contact the other of the first surface of the upper surface plate and the first surface of the lower surface plate in a second polishing operation.

17. The wafer polishing apparatus according to claim 16, wherein the control unit controls the lift unit to cause the first surface of the carrier to again contact the one of the first surface of the upper surface plate and the first surface of the lower surface plate in a third polishing operation.

* * * * *